US012492610B2

(12) United States Patent
Ferreira Da Silva

(10) Patent No.: US 12,492,610 B2
(45) Date of Patent: Dec. 9, 2025

(54) SYSTEM AND METHOD FOR ISOLATION AND CHEMICAL INJECTION IN A COMPLETION STRING OF OIL WELLS WITH OPEN INTERVALS

(71) Applicant: PETRÓLEO BRASILEIRO S.A.—PETROBRAS, Rio de Janeiro (BR)

(72) Inventor: Mario Germino Ferreira Da Silva, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 18/986,232

(22) Filed: Dec. 18, 2024

(65) Prior Publication Data

US 2025/0237117 A1 Jul. 24, 2025

(30) Foreign Application Priority Data

Dec. 19, 2023 (BR) ..... 1020230268854

(51) Int. Cl.

| | |
|---|---|
| ***E21B 33/127*** | (2006.01) |
| ***E21B 33/124*** | (2006.01) |
| ***E21B 34/06*** | (2006.01) |
| ***E21B 34/14*** | (2006.01) |
| ***E21B 37/06*** | (2006.01) |

(52) U.S. Cl.

CPC ..... *E21B 33/1243* (2013.01); *E21B 34/063* (2013.01); *E21B 34/14* (2013.01); *E21B 37/06* (2013.01); *E21B 2200/06* (2020.05)

(58) Field of Classification Search

CPC ..... E21B 33/127; E21B 33/1277
USPC ..... 166/187
See application file for complete search history.

(56) References Cited

U.S. PATENT DOCUMENTS

| | | | | |
|---|---|---|---|---|
| 4,484,626 | A * | 11/1984 | Kerfoot | E21B 49/08 277/331 |
| 6,854,522 | B2 * | 2/2005 | Brezinski | E21B 43/103 166/387 |
| 7,431,098 | B2 * | 10/2008 | Ohmer | E21B 33/1208 166/387 |
| 7,597,152 | B2 * | 10/2009 | Wood | E21B 33/1208 166/387 |
| 8,448,713 | B2 * | 5/2013 | Munshi | E21B 33/127 166/243 |
| 8,490,708 | B2 * | 7/2013 | Nutley | E21B 33/1208 166/387 |
| 8,499,843 | B2 * | 8/2013 | Patel | E21B 33/1277 166/387 |

(Continued)

*Primary Examiner* — Kenneth L Thompson
(74) *Attorney, Agent, or Firm* — Kilpatrick Townsend & Stockton

(57) ABSTRACT

The present invention discloses a system for isolation and chemical injection in a completion string of oil wells with open intervals, comprising an inflatable inner bag and a swellable material, a chemical injection hydraulic line circuit of a chemical injection system, and at least one chemical injection mandrel. The chemical injection hydraulic line circuit is of the feedthrough type and is in fluid communication with the inner bag and at least one inflatable and swellable packer. Furthermore, a method for isolation and chemical injection in a completion string of wells with open intervals is disclosed.

10 Claims, 8 Drawing Sheets

(56) References Cited

U.S. PATENT DOCUMENTS

| | | | | |
|---|---|---|---|---|
| 9,243,490 | B2 * | 1/2016 | Ade-Fosudo | E21B 33/1275 |
| 9,273,533 | B2 * | 3/2016 | Allison | E21B 23/06 |
| 12,320,226 | B2 * | 6/2025 | Moses | E21B 23/06 |
| 2006/0042801 | A1 * | 3/2006 | Hackworth | E21B 43/103 166/387 |
| 2022/0341280 | A1 * | 10/2022 | Holderman | E21B 34/14 |

* cited by examiner

SYSTEM AND METHOD FOR ISOLATION AND CHEMICAL INJECTION IN A COMPLETION STRING OF OIL WELLS WITH OPEN INTERVALS

CROSS-REFERENCES TO RELATED APPLICATIONS

This application claims the benefit of priority to Brazilian Patent Application No. BR 1020230268854 filed Dec. 19, 2023, the contents of which are hereby incorporated by reference in their entirety for all purposes.

FIELD OF THE INVENTION

The present invention relates to the technical field of methods and devices for isolating oil well borehole intervals. More specifically, the present invention relates to a system and method for isolating and chemically injecting a well completion string with open intervals.

BACKGROUND OF THE INVENTION

A swellable packer is an isolation device that generally relies on elastomeric materials to expand and form an annular seal when immersed in certain well fluids. The elastomeric materials used in these packers are generally sensitive to oil or water.

The seating of swellable packers is generally performed by an operation of lowering these packers in a completion string to a designed depth. After positioning the swellable packers in the intervals that were selected in the well completion design, the swelling process is initiated and, when completed, a selectivity of the producing intervals comprised between the swellable packers is obtained.

However, swellable packers comprise some risks and difficulties associated with their use. Notably, once positioned at the designed depth, swellable packers can take 3 to 10 days to complete their swelling process. During this swelling period, it is not advisable or possible to perform chemical treatment operations in the well intervals, as there is no guarantee that the intervals will be selective. In other words, during the swelling period, there is no guarantee that the sealing performed by the swellable packer is already secure enough to allow pressurization around the packers, ensuring their sealing against the formation.

Therefore, if the long period is not waited for the packers to complete the swelling process, some undesirable situations may occur. For example, in the case of intervals with significant static pressure differences, or intervals with fracture gradients close to the pumping pressure values that will be used in chemical treatments, there is a risk of situations ranging from the flow being directed to an undesirable interval due to a lack of selectivity (this is due to the packer not having yet completed the necessary swelling time), to the occurrence of fracturing in an interval with a lower fracture gradient value (this can occur simply due to the value of the resulting hydrostatic pressure as a function of the true vertical depth (TVD) associated with the weight of the fluid to be used in the treatment).

Therefore, there is a need for advances in solutions for isolating well completion intervals to perform segregation between producing intervals more quickly and at a reduced cost.

STATE OF THE ART

The State of the Art discloses some documents that contain teachings regarding methods and devices for isolating and/or treating wellbore intervals.

The document U.S. Pat. No. 7,322,422 B2 discloses a completion assembly for use in a well, including at least one inflatable packer, at least one control line, and at least one source of pressurized fluid, wherein at least one source of pressurized fluid is in fluid communication with at least one inflatable packer through at least one control line.

The document WO 2005052308 A1 discloses an inflatable (bag) that has a swellable layer. The swellable layer may be integrated or attached to an element or may be connected or otherwise attached to a mandrel. Upon inflation with fluid, the element expands into sealing contact with a surrounding tubular or wellbore. Said fluid is absorbed into, or otherwise interacts with, the swellable layer so that, in a preferred embodiment, the total occupied volume of the swellable layer and fluid individually is retained after mixing with the layer filler acting to maintain a uniform seal of the inflatable element if a sealing element failure occurs.

The document U.S. Pat. No. 8,499,843 B2 discloses a sealing system, such as a packer, that is used in a wellbore to seal against an external surface, such as a casing or open wellbore. The sealing system includes a swellable material that changes from an unexpanded state to an expanded state, thereby creating a seal when the swellable material comes into contact with a trigger fluid.

The document PI 0314637-5 B1 discloses apparatus and methods for forming an annular insulator in a borehole after installation of production piping. The annular sealing device is carried in or within the production pipeline as it develops into a borehole. In combination with the expansion of the pipeline, the seal is unfolded to form an annular insulator. An inflatable element carried in the pipeline may be inflated with a fluid carried in the pipeline and forced into the inflatable element during the expansion of the pipeline. Reactive chemicals may be carried in the pipeline and injected into the annular crown to react with each other and with ambient fluids to swell and harden within an annular seal. An elastomeric sleeve, ring or band carried in the pipeline may expand to contact with the borehole wall and may have its radial dimension increased in conjunction with the expansion of the pipeline to form an annular insulator.

However, the pipeline in document PI 0314637-5 is apparently a small diameter pipeline, the flow rates of which are generally in the range of 2 to 4 liters per minute, which is just sufficient to meet the inflation requirements of packers.

Furthermore, it is known from the State of the Art that, depending on the chemical product to be used in the piping, specific metallurgy is required to resist differences in pH and/or alkalinity, in value ranges that may be corrosive to the piping normally used, thus causing damage to said piping.

It is evident that deficiencies persist in the State of the Art. Therefore, the characteristics and advantages of the present invention will clearly emerge from the detailed description below and with reference to the attached drawings, which are provided only as preferred and non-limiting embodiments.

BRIEF DESCRIPTION OF THE INVENTION

The present invention discloses a system for isolation and chemical injection in a completion string of oil wells with open intervals, comprising an inflatable inner bag and a swellable material, a hydraulic chemical injection line circuit of a chemical injection system, and at least one chemical injection mandrel. The chemical injection hydraulic line circuit is of the feedthrough type and is in fluid communication with the inner bag of at least one inflatable and swellable packer. Furthermore, a method for isolation and chemical injection in a well completion string with open intervals is disclosed.

BRIEF DESCRIPTION OF THE FIGURES

In order to complement this description and obtain a better understanding of the characteristics of the present invention, figures are shown in which, in an exemplary and non-limiting manner, its preferred embodiments are represented.

DETAILED DESCRIPTION OF THE INVENTION

The present invention relates to a system and method for isolation and chemical injection in a completion string of oil wells with open intervals.

The primary technical problem that motivated the invention was the need to ensure the isolation of intervals of open production wells during the completion phase of these wells, in which swellable packers are normally applied, which generally require a long time to complete the swelling process before chemical treatment is possible in the production intervals.

The solution achieved by the invention makes it possible to perform isolation and treatment between production intervals more quickly. To perform the isolation, two general steps are involved. First, an inner part of the packer is inflated with a fluid, so that it can already be adhered to the production formation, performing an initial seal. Second, as the swellable (elastomeric) material of the packer expands after contact with said fluid, the overall adhesion of the packer will gradually increase, further improving the sealing process in relation to the wall of the open well. In this way, the proposed solution makes it possible to advance the process of laying the packers. By accelerating the process of laying the packers, it is also advantageously possible to anticipate the chemical treatment of the production zones, if necessary.

Figure 1:
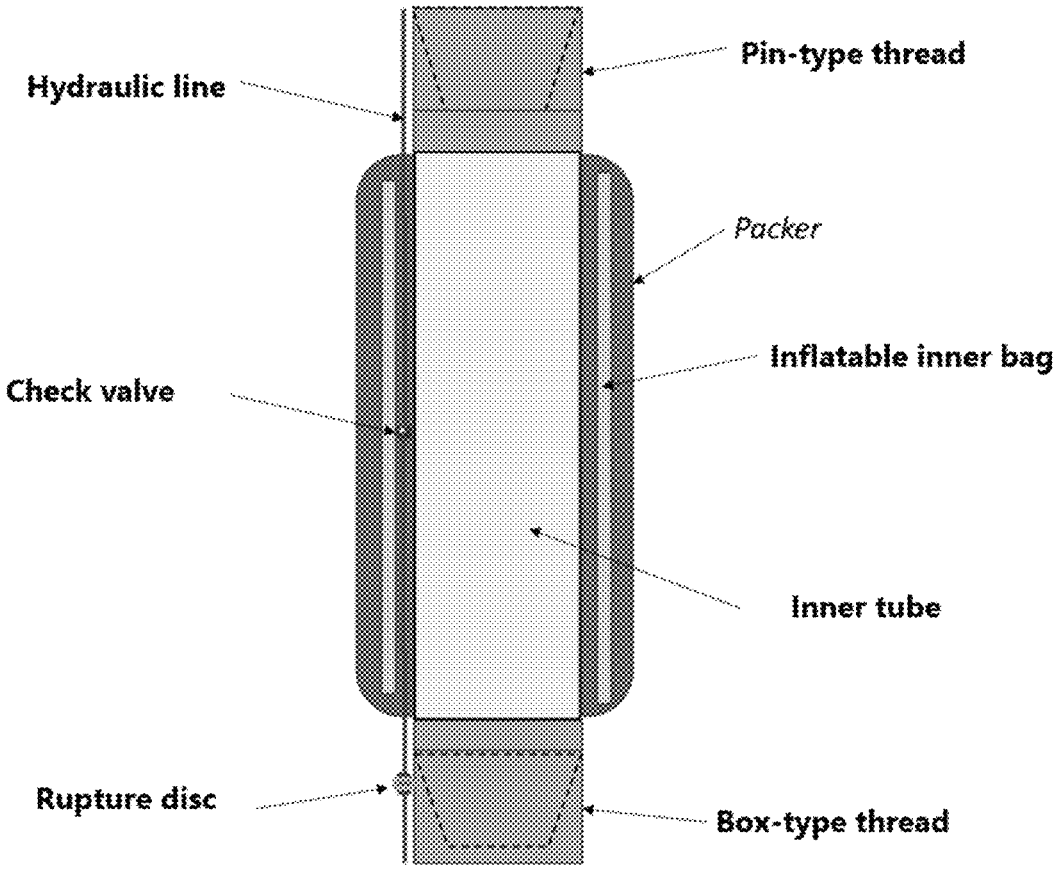
FIG. 1 illustrates a packer and hydraulic line assembly, according to a preferred embodiment of the present invention.

More particularly, as illustrated in FIG. 1, the present invention comprises a packer equipped with an inflatable inner part, an inner tube, a pin-type thread and a box-type thread, a hydraulic line, a check valve, and a rupture disc.

Figure 5:
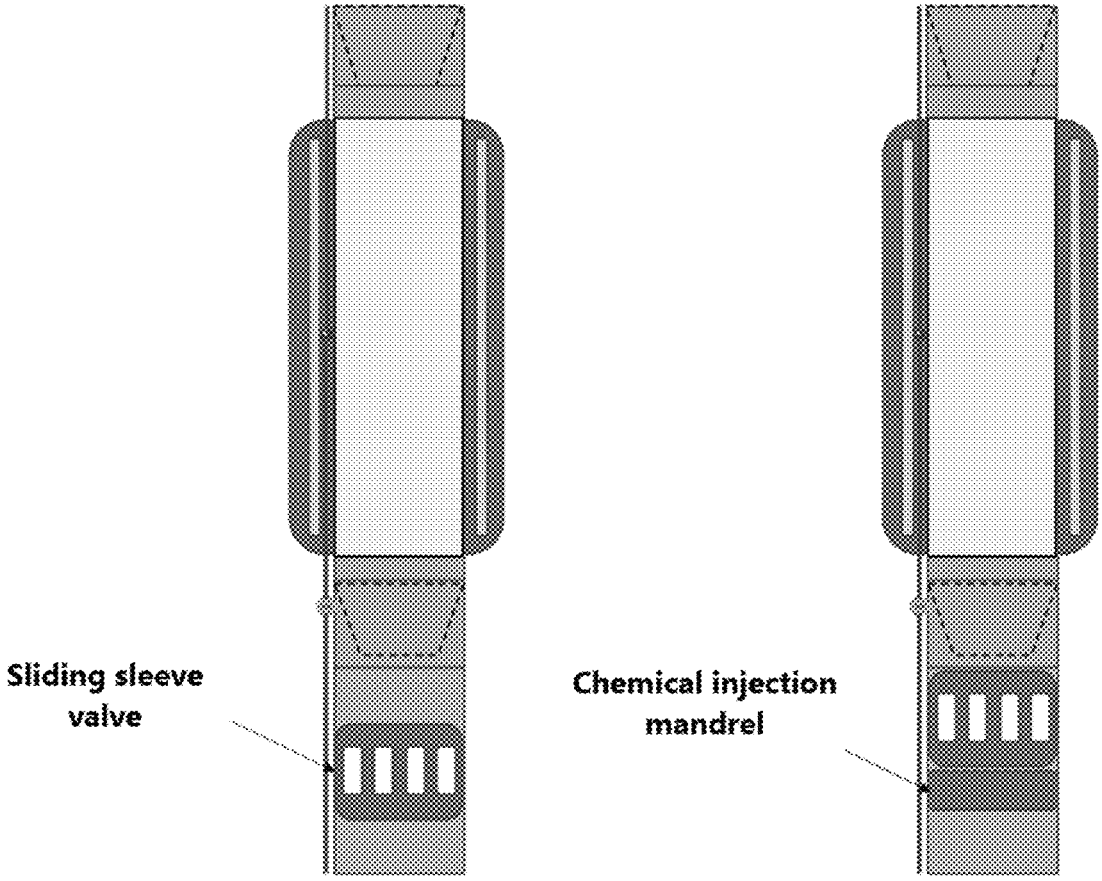
FIG. 5 illustrates the packer assembly further comprising sliding sleeve valves and chemical injection mandrels.

The packer will be inflated using a selected hydraulic fluid, which will be positioned inside an inflatable bag of the packer. To make this possible, an adaptation will be made in a hydraulic line of a chemical injection system installed in the completion string, originally intended to conduct a scale inhibitor product to a chemical injection mandrel (CIM), with the adaptation being made to pass between the external rubber of the packer and the production string. Said hydraulic line is of the feedthrough type in relation to the packer; this means that the line passes parallel to the string through the space between the string and the rubber of the packer. To this end, the packer assembly also includes sliding sleeve door (SDD) valves that release the respective chemical injection mandrels for each of the well intervals, as illustrated in FIG. 5.

Figure 2:
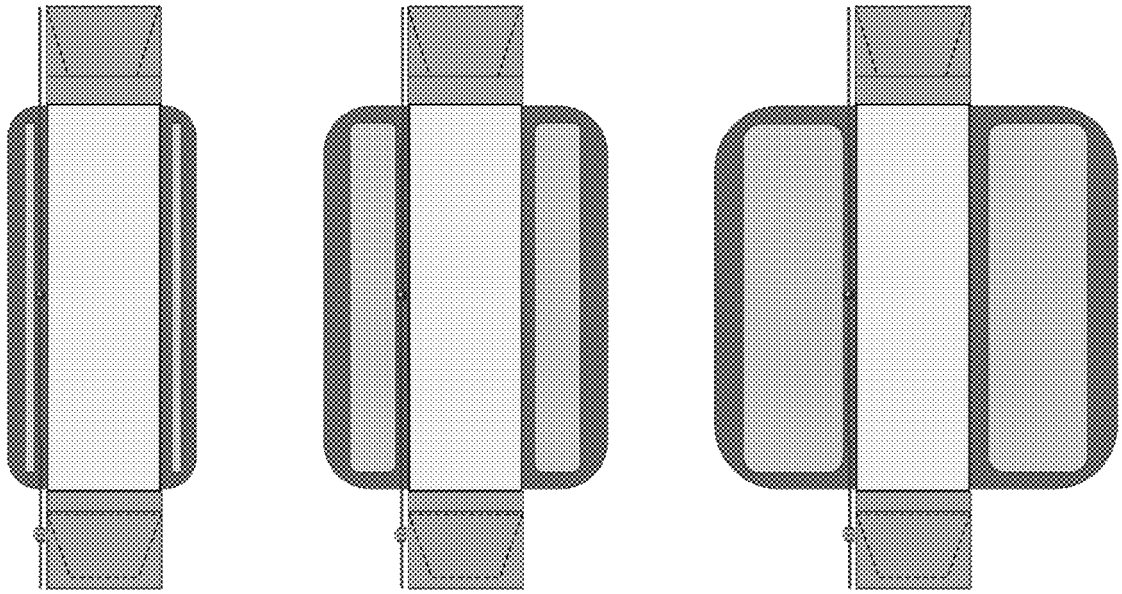
FIG. 2 illustrates an exemplary sequence of inflation of a packer, according to a preferred embodiment of the present invention.
Figure 3:
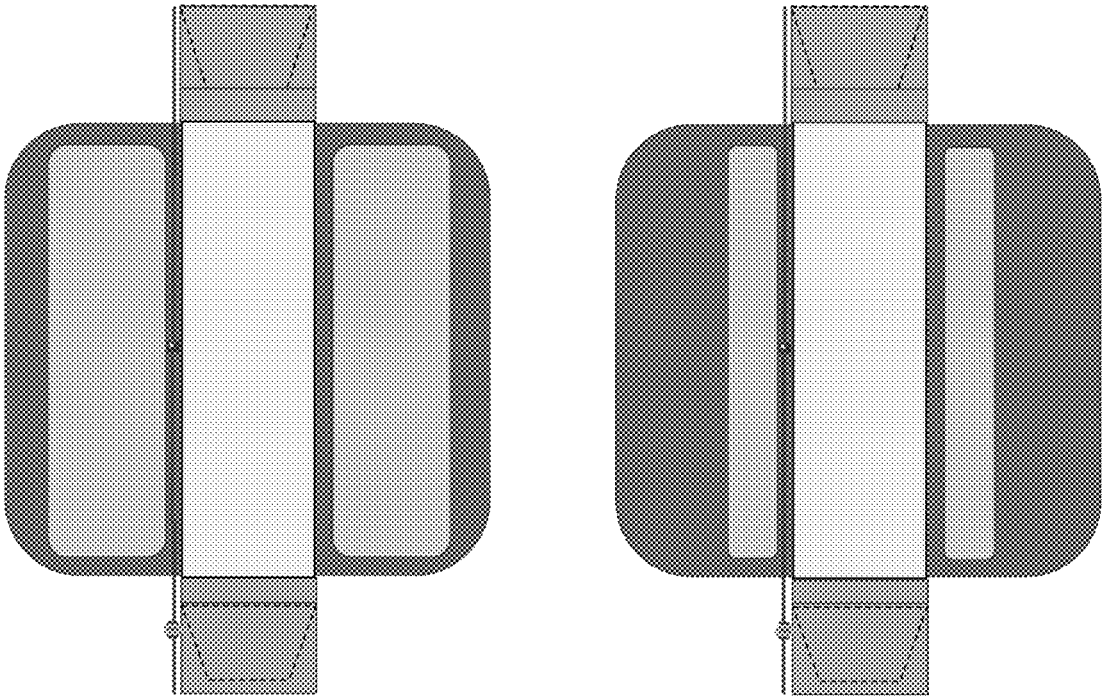
FIG. 3 illustrates an exemplary sequence of swelling of a packer, according to a preferred embodiment of the present invention.

The selected hydraulic fluid will be applied with two functions, the first being to promote the inflation of the inner bag in the packer, through fluid communication with the feedthrough hydraulic line, as illustrated sequentially in FIG. 2. A second function will be that the selected hydraulic fluid will react with the packer rubber, on the inner part of it, to cause the gradual swelling of the packer rubber from the inside to the outside, as illustrated sequentially in FIG. 3.

Figure 4:
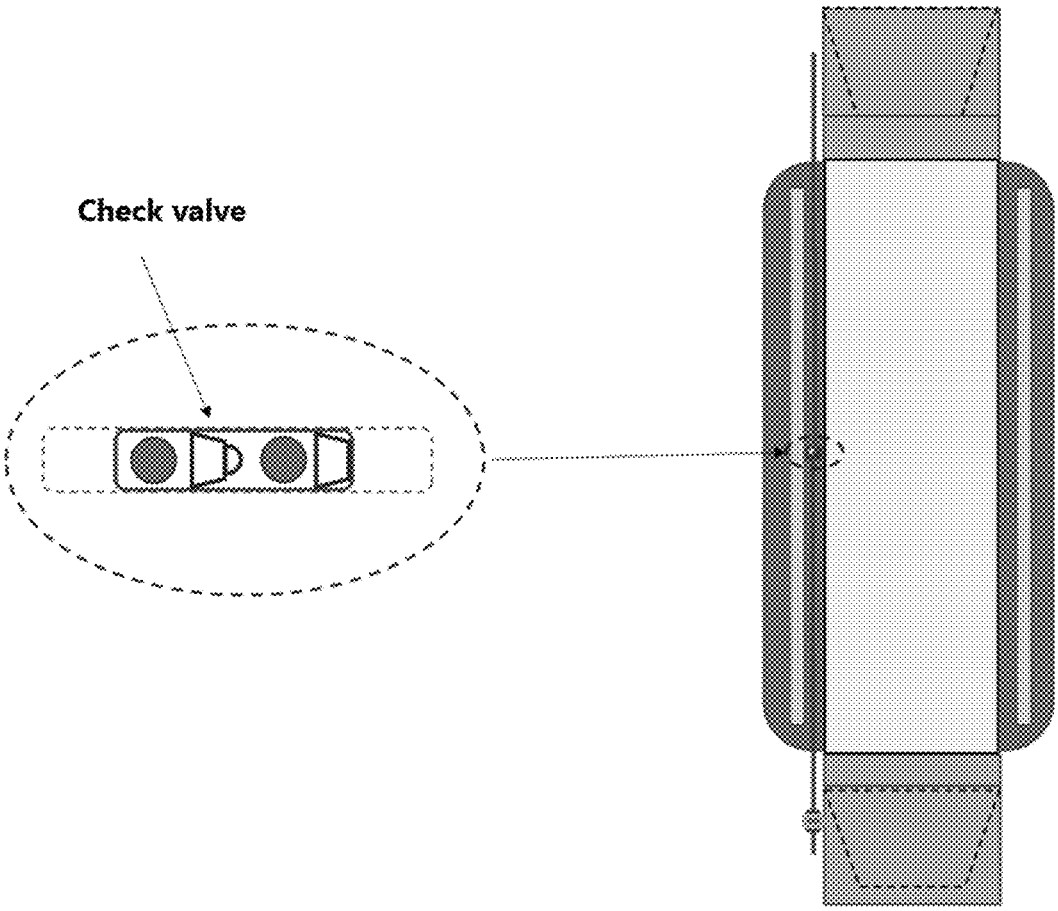
FIG. 4 illustrates in greater detail a check valve in the valve assembly in the hydraulic line.

To this end, the packer has a set of valves in the line equipped with check valves, as illustrated in FIG. 4, preferably of the double check valve type, whose purpose is to allow the flow to pass in the direction of the line to the inside of the bag inside the packer, aiming at the packer inflation process. The check valves will allow hydraulic fluid to enter the interior of the bag, inflating the packer, but will not allow it to exit the interior of the bags.

It will also be appreciated that a locking of the check valve after the packer has inflated allows the fluid placed inside the bag to remain inside it to promote absorption by the packer rubber and thus promote swelling.

The gradual swelling of the packer rubber, caused by the reaction of the packer rubber with the selected hydraulic fluid, will act as a complementary method of fixing the packer to the well wall. More specifically, the liquid used to inflate the packer will be absorbed by it, passing from the initial inflation process to the secondary swelling process, thus transforming the bag initially inflated by fluid into a layer of the consolidated bag material, which will be positioned between the well wall and the string, thus obturating the annular space between the string and the well wall.

Following the packing of the packer, when the inner pressure in the packer bag reaches, or is induced to reach, a certain designed value, a rupture disc fitted in the feedthrough line circuit will rupture. In this sense, synchronization can be implemented between the check valves of each packer and the rupture discs positioned after each packer.

Figure 6:
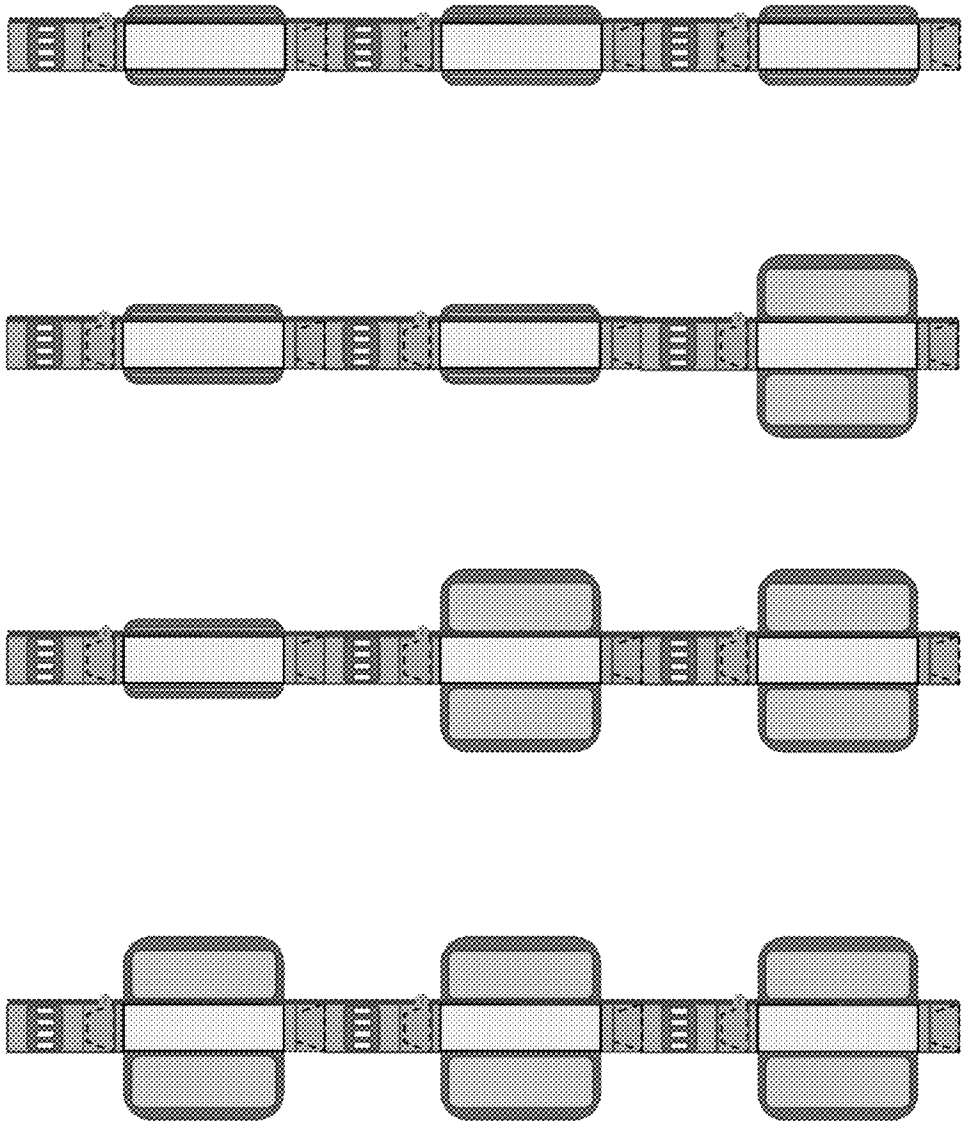
FIG. 6 illustrates a preferred sequence of installation and seating of respective packers.

Therefore, as illustrated in FIG. 6, each packer can be inflated separately following the inflation of a previous packer. More specifically, the set of valves mentioned enables an operating sequence with the objective of meeting a sequence of installation and seating of respective packers (by inflation and swelling) in the annular space between the string and the well wall for each interval.

It will also be appreciated that the rupture disc burst pressure values can be scaled in an increasing manner between the packers, considering the hydrostatic pressure at the depth of each packer, such that an increasing pressure value will be required for the rupture of each disc, in the sequence from top to bottom.

Figure 7:
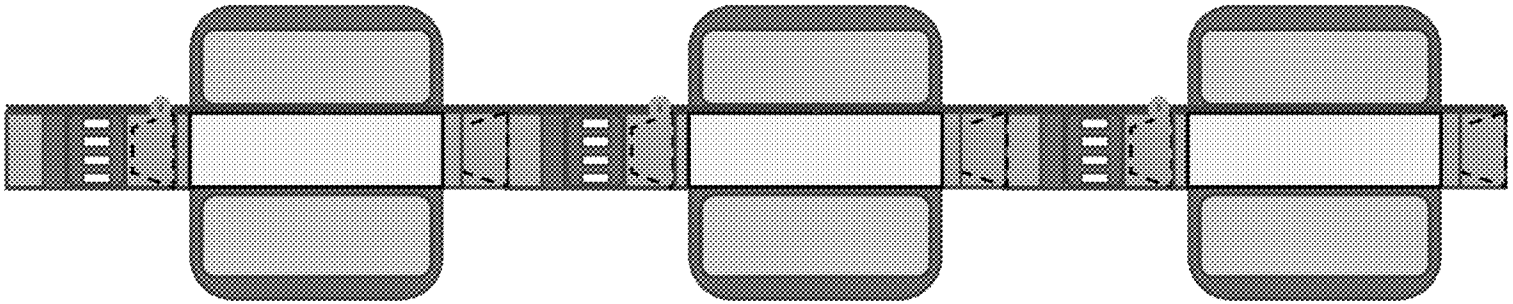
FIG. 7 illustrates the selective release of the alignment of the original inhibitor fluid circulation circuit for respective chemical injection mandrels adapted in the string using sliding sleeve valves.
Figure 8:
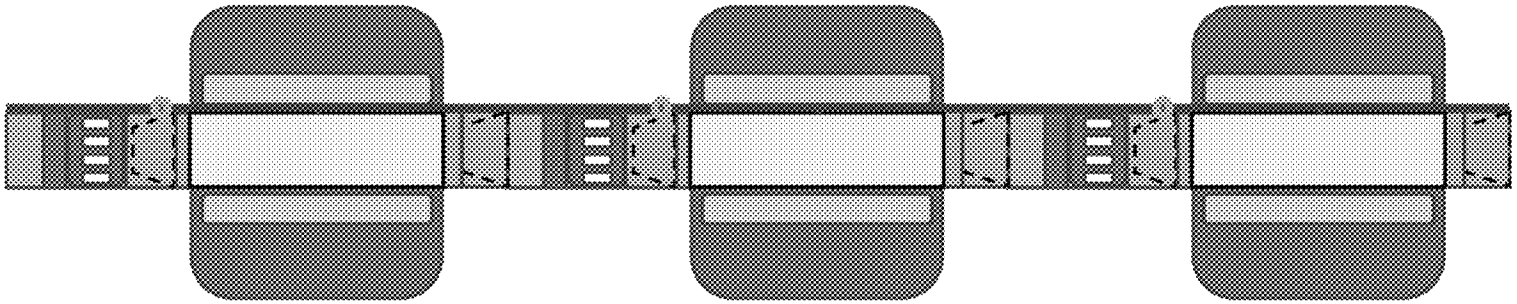
FIG. 8 illustrates the eventual swelling of the packers after selective release of the alignment of the original circuit.

Furthermore, as illustrated in FIG. 7, the valve assembly allows, after the installation and seating of the respective packers, the selective release of the alignment of the original inhibitor fluid circulation circuit to the respective chemical injection mandrels adapted in the string using sliding sleeve door valves (SDD) for each of the well intervals. Furthermore, FIG. 8 illustrates the eventual swelling of the respective packers over time after the selective release of the alignment of the original circuit.

It will be appreciated that the adaptation in a hydraulic line by the present invention, originally of a chemical injection system installed in the completion string and with the objective of conducting a scale inhibitor product to a chemical injection mandrel, brings a series of advantages over the State of the Art.

One of these advantages is related to issues of flow loss. The reuse of a chemical injection system for inflating and swelling packers and subsequently for treatment in order to meet the flow rates required to perform chemical treatments in wells is an unusual solution in the technical field of the present invention. It is observed that in offshore (subsea) installations, the chemical treatment flow rates to the well reservoirs are normally high, and can vary on average from 3 to 10 barrels per minute (1 bbl=159 liters) and, therefore, pipes normally used for inflating packers would not be suitable for subsequent chemical treatments.

Therefore, it will be appreciated by a person skilled in the art that the present invention has applications in several areas, such as in the area of production development, in the construction of wells, in well completion equipment with open intervals; that is, without casing, and to accelerate the process of laying packers.

The present invention is also used in the area of reservoir management within water management, aiming to accelerate chemical treatments with scope of opportunity, and in flow assurance (GARESC), to collaborate with the planning of proactive chemical treatment operations to prevent incrustations inside subsea systems such as production lines, manifolds and risers.

Furthermore, it will be appreciated that the present invention, because it has particular application in formations with low fracture gradient that require speed in carrying out annulus isolation, allows the next operations to be carried out in the reservoir with pressure values above the fracture pressures of the layers that were isolated by the packer. Therefore, the invention seeks to avoid the possibility of loss of selectivity of the intelligent completion, due to the possibility of fracture of the low fracture pressure zones occurring, and thus undesirable communication between the intervals isolated by the packers occurring.

In addition to the above, the present invention also brings a plurality of additional advantages. Among these, some are listed, but not exhaustively, below.

Economic and productivity advantages: the laying of the packer with inflation followed by swelling will allow the packing operation to be accelerated and, consequently, the isolation of the intervals will allow the selectivity of these intervals, so that acidification and/or chemical treatment operations such as inhibitions and proactive squeeze can be carried out, without the risk of crossflow (communication between zones) occurring immediately after the packer is inflated, thus allowing these treatments to be carried out with the same rig that installed the completion string, thus reducing the cost associated with operations with vessels and/or light workover rigs (153 thousand US$/day).

Health and safety advantages: reducing the need for additional operations using boats and/or light workover rigs reduces the risk associated with operations with these vessels, from docking between boats and stationary production units and/or light workover rigs, in addition to the risk of collision (collision between vessels) due to the combination of sea conditions and malfunctioning of the machinery of the vessels.

Reliability advantages: improves reliability in the selectivity of interval isolation, as it ensures that isolation between the producing intervals of the oil well is carried out during the installation phase, which in the previous model would take a long time to be completed only by the chemical reaction of the rubber swelling with the well fluid. It also improves fluid contact, which causes swelling with the packer, due to the inner filling.

Environmental advantages: reducing the use of well stimulation vessels (WSSV) and light workover rigs reduces carbon dioxide emissions, as well as waste discarded at sea by these vessels during their operations, which will contribute to environmental preservation.

Social advantages: ensuring production maintenance, given the proactive treatments that can be performed, such as pre-inhibition and pre-squeeze, directly contributes to maintaining royalty payments.

Preferred Embodiments

In a preferred embodiment, the present invention discloses a system for isolation and chemical injection in a completion string of oil wells with open intervals, which comprises:

- at least one inflatable and swellable packer assembly, comprising an inflatable inner bag and a swellable material;
- a chemical injection hydraulic line circuit of a chemical injection system; and
- at least one chemical injection mandrel,
- wherein the chemical injection hydraulic line circuit is of the feedthrough type and is in fluid communication with the inner bag of the at least one inflatable and swellable packer and, in a first configuration, the chemical injection hydraulic line circuit supplies a fluid to fill the inflatable inner bag, which reacts with the swellable material of the at least one inflatable and swellable packer,
- wherein the chemical injection hydraulic line circuit further comprises respective valve assemblies for each of the at least one inflatable and swellable packer, and wherein the valve assemblies respectively comprise at least one double check valve and a rupture disc, and
- wherein after inflation of the at least one inflatable and swellable packer, the chemical injection hydraulic line circuit is selectively switched to a second configuration for injection of a scale inhibitor fluid through the at least one chemical injection mandrel.

The system may further comprise respective sliding sleeve door (SDD) valves for each of the well intervals. Furthermore, the inflatable and swellable packer assembly may further comprise a pin-type thread, an inner tube and a box-type thread.

Preferably, the system is implemented in a completion string with three intervals in which the rupture discs comprise respective values of burst pressure in an increasing manner between the respective packers.

In another preferred embodiment, the present invention discloses a method for isolation and chemical injection in a well completion string with open intervals, which comprises the steps of:

a. introducing into the well an assembly of at least one inflatable and swellable packer comprising an inflatable inner bag and a swellable material, a chemical injection hydraulic line circuit of a feedthrough chemical injection system and which is in fluid communication with the inner bag of at least one inflatable and swellable packer, and at least one chemical injection mandrel;

b. pumping, in a first configuration, a first fluid through the chemical injection hydraulic line circuit to initiate an inflation of the inflatable inner bag of at least one inflatable and swellable packer;

c. inflating the inflatable inner bag of at least one inflatable and swellable packer with the first fluid until an external part of the inflatable and swellable packer touches a wall of the well;

d. stop pumping the first fluid after completion of the inflation of the inflatable inner bag of at least one inflatable and swellable packer;

e. gradually increasing the pressure of the first fluid until reaching a bursting pressure of a rupture disc in the chemical injection hydraulic line circuit of at least one inflatable and swellable packer;

f. actuating, after the rupture disc ruptures, a double check valve in the chemical injection and swellable hydraulic line circuit to block the first fluid inside at least one inflatable packer;

g. repeating steps (b) to (f) for additional inflatable and swellable packers to isolate respective open intervals in the well; and h. selectively changing the chemical injection hydraulic line circuit to a second configuration;

i. pumping a second fluid through at least one chemical injection mandrel of respective open intervals in the well.

The method may further comprise actuating respective sliding sleeve door (SDD) valves for each of the intervals in the well. Furthermore, the inflatable and swellable packer assembly may further comprise a pin-type thread, an inner tube and a box-type thread.

Preferably, the method is implemented in a completion string with three intervals in which a rupture of the respective rupture discs between respective packers is promoted through increasing pressure values.

Implementation Example

The following describes, by way of example and not as a limitation, an operating sequence for activating a rupture disc in the hydraulic lines for injection of scale inhibitor, to sequentially inflate a packer in a well completion string with open intervals (also seen in FIG. 6):

The hydraulic fluid is pumped through the inhibitor injection line to inflate the $1^{st}$ packer;

The inner bag of the $1^{st}$ packer is inflated until the external rubber of the packer touches the well wall;

The pumping by hydrostatic pressure is interrupted due to the completion of the filling of the inner bag of the $1^{st}$ packer;

The pumping pressure will be gradually increased until it reaches the rupture value of the $1^{st}$ rupture disc in the inhibitor injection line at the point below the $1^{st}$ packer;

The double check valve in the line of the $1^{st}$ packer bag is activated, blocking the fluid inside the $1^{st}$ packer;

Pumping the hydraulic fluid through the inhibitor injection line to inflate the inner bag of the $2^{nd}$ packer;

The inner bag of the $2^{nd}$ packer is inflated until the external rubber of the packer touches the wall of the well;

Pumping by hydrostatic pressure is interrupted due to the completion of the filling of the inner bag of the $2^{nd}$ packer;

The pumping pressure will be gradually increased until it reaches the rupture value of the $2^{nd}$ rupture disc in the inhibitor injection line at the point between the $1^{st}$ and $2^{nd}$ packer;

The double check valve in the line of the $2^{nd}$ packer bag is activated, blocking the fluid inside the $2^{nd}$ packer;

After the rupture of the $2^{nd}$ rupture disc, pumping the hydraulic fluid through the inhibitor injection line to inflate the $3^{rd}$ packer;

The inner bag of the $3^{rd}$ packer is inflated until the external rubber of the packer touches the well wall;

The pumping by hydrostatic pressure is interrupted due to the completion of the filling of the inner bag of the $3^{rd}$ packer; and The double check valve in the line of the bag of the $3^{rd}$ packer is activated, blocking the fluid inside the 3rd packer.

The rupture pressure values of the rupture discs can be scaled in an increasing manner between the packers, considering the hydrostatic pressure at the depth of each packer, for the rupture of each disc, in the sequence from top to bottom, that is, from the $1^{st}$ packer, $2^{nd}$ packer and $3^{rd}$ packer, for example:

The $1^{st}$ disc ruptures with a 500 PSI differential in the hydrostatic pressure value at the depth point of the $1^{st}$ rupture disc in the direction from top to bottom.

$2^{nd}$ disc ruptures with 1000 PSI of differential hydrostatic pressure value at the depth point of the $1^{st}$ rupture disc in the direction from top to bottom.

$3^{rd}$ disc ruptures with 1500 PSI of differential hydrostatic pressure value at the depth point of the $1^{st}$ rupture disc in the direction from top to bottom.

Those skilled in the art will value the knowledge being shown and will be able to reproduce the invention in the indicated embodiments and in other variants, covered by the scope of the attached claims.

The invention claimed is:

1. A system for isolation and chemical injection in a completion string of oil wells with open intervals comprising:

at least one inflatable and swellable packer assembly, comprising an inflatable inner bag and a swellable material;

a chemical injection hydraulic line circuit of a chemical injection system; and at least one chemical injection mandrel, wherein the chemical injection hydraulic line circuit is of a feedthrough type and is in fluid communication with the inner bag of the at least one inflatable and swellable packer and, in a first configuration, the chemical injection hydraulic line circuit provides a fluid to fill the inflatable inner bag that reacts with the swellable material of the at least one inflatable and swellable packer, wherein the chemical injection hydraulic line circuit further comprises respective valve assemblies for each of the at least one inflatable and swellable packer, and wherein the valve assemblies respectively comprise at least one double check valve and a rupture disc, and wherein after inflation of the at least one inflatable and swellable packer, the chemical injection hydraulic line circuit is selectively switched to a second configuration for injection of a scale inhibitor fluid through the at least one chemical injection mandrel.

2. A system, according to claim 1, further comprising respective sliding sleeve valves for each of the intervals of the well.

3. A system, according to claim 1, wherein the inflatable and swellable packer assembly further comprises a pin-type thread, an inner tube and a box-type thread.

4. A system, according to claim 1, comprised by being implemented in a completion string with three intervals.

5. A system, according to claim 1, wherein the rupture discs comprise respective values of burst pressure in an increasing manner between respective packers.

6. A method for isolation and chemical injection in a completion string of oil wells with open intervals comprising the steps of:

a) introducing into the well an assembly of at least one inflatable and swellable packer comprising an inflatable inner bag and a swellable material, a chemical injection hydraulic line circuit of a feedthrough chemical injection system and which is in fluid communication with the inner bag of the at least one inflatable and swellable packer, and at least one chemical injection mandrel;

b) pumping, in a first configuration, a first fluid through the chemical injection hydraulic line circuit to initiate inflation of the inflatable inner bag of the at least one inflatable and swellable packer;

c) inflating the inflatable inner bag of the at least one inflatable and swellable packer with the first fluid until an external part of the inflatable and swellable packer touches a wall of the well;

d) stopping pumping the first fluid after completing the filling of the inflatable inner bag of the at least one inflatable and swellable packer;

e) gradually increasing the pressure of the first fluid until reaching a burst pressure of a rupture disc in the chemical injection hydraulic line circuit of the at least one inflatable and swellable packer;

f) actuating, after the rupture disc ruptures, a double check valve in the chemical injection and swellable hydraulic line circuit to lock the first fluid inside the at least one inflatable packer;

g) repeating steps (b) through (f) for additional inflatable and swellable packers to isolate their respective open intervals in the well; and h) selectively changing the chemical injection hydraulic line circuit to a second configuration;

i) pumping a second fluid through the at least one chemical injection mandrel of respective open intervals in the well.

7. A method, according to claim 6, further comprising introducing into the well respective sliding sleeve valves for each of the intervals of the well.

8. A method, according to claim 6, further comprising the inflatable and swellable packer assembly and further comprising a pin-type thread, an inner tube and a box-type thread.

9. A method, according to claim 6, comprised by being implemented in a completion string with three intervals.

10. A method, according to claim 6, further comprising the rupture of respective rupture discs between respective packers through increasing pressure values.

* * * * *